US009370776B2

(12) United States Patent
Roozeboom et al.

(10) Patent No.: US 9,370,776 B2
(45) Date of Patent: Jun. 21, 2016

(54) MOUNTING BLOCK FOR ATTACHING A REDUCING ELEMENT TO A ROTARY DRUM

(71) Applicant: Vermeer Manufacturing Company, Pella, IA (US)

(72) Inventors: Keith Leon Roozeboom, Pella, IA (US); Joseph Edward Breja, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 467 days.

(21) Appl. No.: 13/872,876

(22) Filed: Apr. 29, 2013

(65) Prior Publication Data

US 2014/0319258 A1 Oct. 30, 2014

(51) Int. Cl.
*B02C 18/18* (2006.01)
*B02C 18/14* (2006.01)

(52) U.S. Cl.
CPC ..... *B02C 18/18* (2013.01); *B02C 18/145* (2013.01); *Y10T 29/49716* (2015.01)

(58) Field of Classification Search
CPC .. B02C 18/18; B02C 18/145; Y10T 29/49716
USPC ..... 241/282.2, 301, 294; 29/401.1
See application file for complete search history.

(56) References Cited

U.S. PATENT DOCUMENTS 4,009,837 A 3/1977 Schnyder
4,616,734 A * 10/1986 Phelps ..... E04G 3/26 182/117
4,784,337 A 11/1988 Nettles et al.
5,005,620 A 4/1991 Morey
5,274,899 A 1/1994 Sentagnes et al.
5,362,004 A 11/1994 Bateman
5,730,375 A 3/1998 Cranfill et al.
5,819,825 A 10/1998 Lyman et al.
6,027,055 A 2/2000 Doskocil
6,032,707 A 3/2000 Morey et al.
6,290,217 B1 * 9/2001 Schneider ..... F16F 7/14 188/378
6,343,755 B1 2/2002 Barclay et al.
7,172,147 B2 2/2007 Diemunsch
7,293,729 B2 11/2007 Ragnarsson
7,384,011 B1 6/2008 Smith
7,506,674 B2 3/2009 Biller et al.
7,980,502 B2 7/2011 Doppstadt et al.
8,061,640 B2 11/2011 Cotter et al.
2008/0061176 A1 3/2008 Smith
2008/0105334 A1 5/2008 Leonardi et al.
2009/0242677 A1 10/2009 Smidt et al.
2010/0043922 A1 * 2/2010 Leonardi ..... A01G 23/067 144/235
2010/0083588 A1 * 4/2010 Hockman ..... E04D 13/10 52/24

FOREIGN PATENT DOCUMENTS

DE 102005007676 B3 7/2006
DE 202008000189 U1 5/2008
EP 1985428 A1 4/2008
EP 2233260 A2 3/2010
JP 8299825 11/1996
WO 2012096560 A1 7/2012

* cited by examiner

*Primary Examiner* — Mark Rosenbaum
(74) *Attorney, Agent, or Firm* — Armstrong Teasdale LLP

(57) ABSTRACT

Mounting blocks for attaching reducing elements to a rotary drum of a comminuting apparatus are disclosed. The mounting blocks may be mounted in multiple positions to vary the bite of the reducing elements of the rotary drum.

20 Claims, 12 Drawing Sheets

MOUNTING BLOCK FOR ATTACHING A REDUCING ELEMENT TO A ROTARY DRUM

CO-PENDING, CO-OWNED APPLICATIONS INCORPORATED HEREIN

The present application incorporates U.S. application Ser. No. 13/872,737, filed Apr. 29, 2013, entitled Adjustable Anvil for Comminuting Apparatus and U.S. application Ser. No. 13/872,801, filed Apr. 29, 2013 entitled Adjustable Cutter for use in Comminuting Apparatus, herein by reference for all relevant and consistent purposes.

FIELD OF THE DISCLOSURE

The field of the disclosure relates to mounting blocks for attaching reducing elements to a rotary drum of a comminuting apparatus and, in particular, mounting blocks that may be mounted in multiple positions to vary the bite of the reducing element of the rotary drum.

BACKGROUND

Comminuting apparatus such as grinders and chippers are used to mechanically grind, chip or shred material to reduce the size of the material. Such apparatus may be used to reduce the size of arboraceous material such as tree limbs, stumps or brush in land-clearing, municipal waste and composting operations and may be used to process other materials such as, by way of example only, building materials, organic or inorganic filamentary materials, etc. Chippers and grinders may include a power in-feed mechanism that forces larger material (e.g., wood-based material such as tree trunks, tree branches, logs, etc.) into contact with a rotating comminuting drum (which may also be referred to herein simply as a "rotary drum"). As the material is forced forward by the power in-feed system, the material encounters the rotary drum and is comminuted. The material is contacted by rotating reducing elements such as teeth, grinding elements or "knives" and portions of the material are forced past a reducing edge defined by an anvil of the apparatus.

Upon passing the reducing edge of the anvil, the material enters a chamber and is discharged. Upon passing through the chamber, the reduced material is typically deposited on a discharge conveyor that carries the reduced material to a collection location. An example of a horizontal grinder is disclosed in US Patent Publication No. 2009/0242677, which is incorporated herein by reference for all relevant and consistent purposes.

A continuing need exists for comminuting apparatus that allow for the bite of the reducing element to be varied. A continuing need also exists for methods for adjusting the apparatus to vary the bite of the reducing element.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to a mounting block for attaching a reducing element to a rotary drum for comminuting material. The mounting block includes a top surface, a bottom surface opposite the top surface, a front mounting surface and a back mounting surface opposite the front mounting surface. The block includes at least two rows of block through-holes within the mounting block that are parallel to the top surface and bottom surface. The block through-holes are configured for attaching the mounting block to the rotary drum. The block through-holes extend through the front mounting surface. The top row of block through-holes nearest the top surface is a distance $D_1$ from the top surface. The bottom row of block through-holes nearest the bottom surface is a distance $D_2$ from the bottom surface. $D_1$ is generally different from $D_2$. The block includes an opening that extends through the top surface, the opening being configured for attaching a reducing element to the mounting block.

Another aspect of the present disclosure is directed to a mounting block for attaching a reducing element to a rotary drum for comminuting material. The mounting block includes a top surface, a bottom surface opposite the top surface, a front mounting surface and a back mounting surface opposite the front mounting surface. The block includes a row of block through-holes that are parallel to the top surface and bottom surface. The block through-holes are configured for attaching the mounting block to the rotary drum. The block through-holes extend through the front mounting surface and back mounting surface. The row of block through-holes is a distance $D_1$ from the top surface and a distance $D_2$ from the bottom surface. $D_1$ is generally different from $D_2$. The block includes an opening that extends through the top surface. The opening is configured for attached a reducing element to the mounting block.

A further aspect of the present disclosure is directed to a rotary drum for comminuting material. The rotary drum has an axis of rotation and includes a mounting surface and a mounting block removably mounted to the mounting surface. The mounting block includes a front mounting surface and a back mounting surface opposite the front mounting surface. The back mounting surface abuts the mounting surface. The mounting block includes at least two rows of block through-holes that extend through the front mounting surface and the back mounting surface. The rows are parallel to the axis of the drum. The rotary drum includes a reducing element mounted to the mounting block. The reducing element has a reducing edge for comminuting material.

Another aspect of the present disclosure is directed to a method for adjusting the bite of a reducing element of a comminuting drum. The drum includes a mounting surface, a mounting block removably mounted to the mounting surface and a reducing element. The mounting block has a top surface, a bottom surface opposite the top surface, a front mounting surface, a back mounting surface opposite the front mounting surface and abutting the mounting surface and at least two rows of block through-holes that are parallel to the top surface and bottom surface. The block through-holes are configured for attaching the mounting block to the rotary drum. The block through-holes extend through the front mounting surface and back mounting surface. The reducing element is disposed on the top surface of the mounting block. The mounting block is removed from the mounting surface. The reducing element is removed from the top surface of the mounting block. The reducing element is mounted to the mounting block such that the reducing element is disposed on the bottom surface of the mounting block. The mounting block is mounted to the mounting surface after the reducing element has been mounted to the mounting block such that the reducing element is disposed on the bottom surface of the mounting block.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
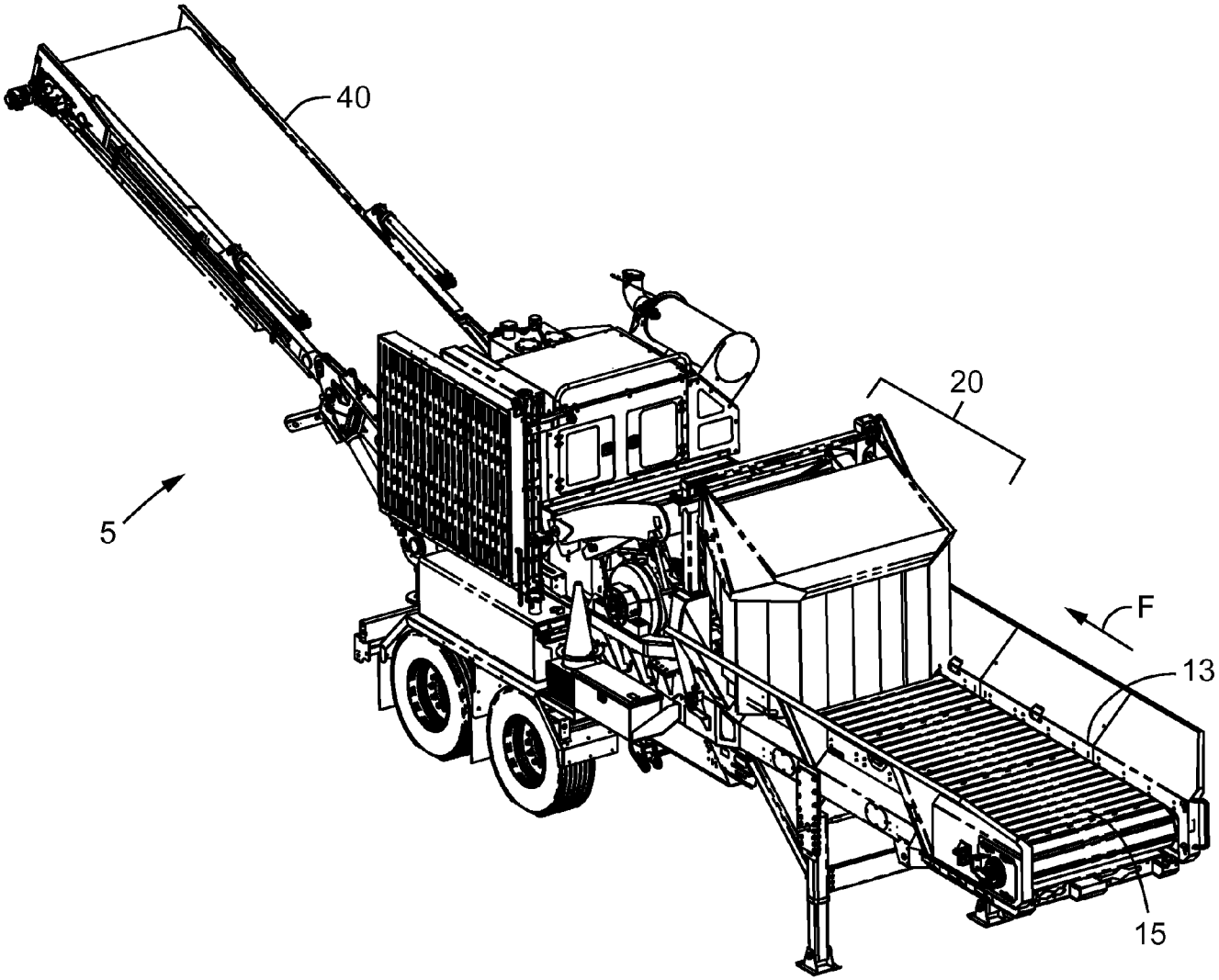
FIG. 1 is a perspective view of an apparatus for reducing the size of material being processed.

An embodiment of an apparatus for reducing the size of material is generally referred to as "5" in FIG. 1. The apparatus 5 is depicted as a horizontal grinder having a power in-feed system 13, a comminuting assembly 20 and a discharge conveyor 40. While the present disclosure has been described with reference to a horizontal grinder, it should be noted that the principles described herein (e.g., a dual mount mounting block) may also apply to any suitable apparatus for comminuting arboraceous or other material such as a wood chipper having a chute for discharging comminuted material.

Figure 2:
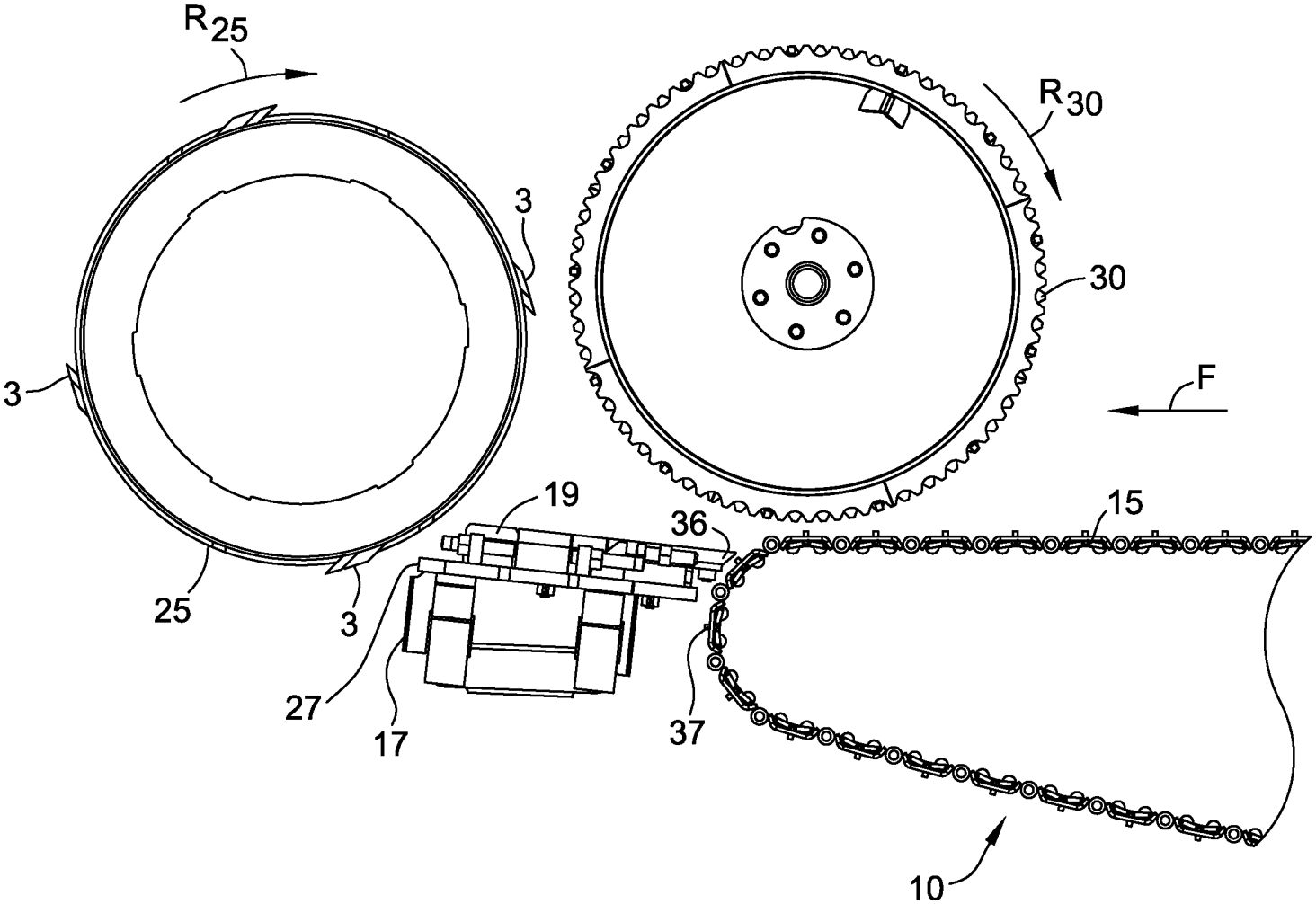
FIG. 2 is a side view of the in-feed system, anvil, feed roller and comminuting drum of the apparatus.

The in-feed system 13 of the comminuting apparatus 5 includes an endless conveyor belt 15 to move the material toward a comminuting drum 25 (FIG. 2) in a feed direction indicated by arrow F. As shown in FIG. 2, the in-feed system has a first end 37 proximal to an anvil 17. The anvil 17 is disposed between the conveyor belt 15 and a comminuting drum 25 to bridge the gap between the conveyor belt 15 and the comminuting drum 25. A feed roller 30 rotates about an axis in direction $R_{30}$ to force material over the anvil 17 and to contact the comminuting drum 25. The anvil 17 includes a first end 27 adjacent the drum 25 and a second end 36 adjacent the conveyor belt 15.

The comminuting drum 25 carries a plurality of reducing assemblies 3 having a reducing element (e.g., teeth, blades, knives, etc. and/or combinations of these elements) attached thereto. During operation, the comminuting drum 25 rotates about an axis of rotation in direction $R_{25}$ such that the tips of the reducing assemblies 3 define a circumferential reducing path.

Figure 3:
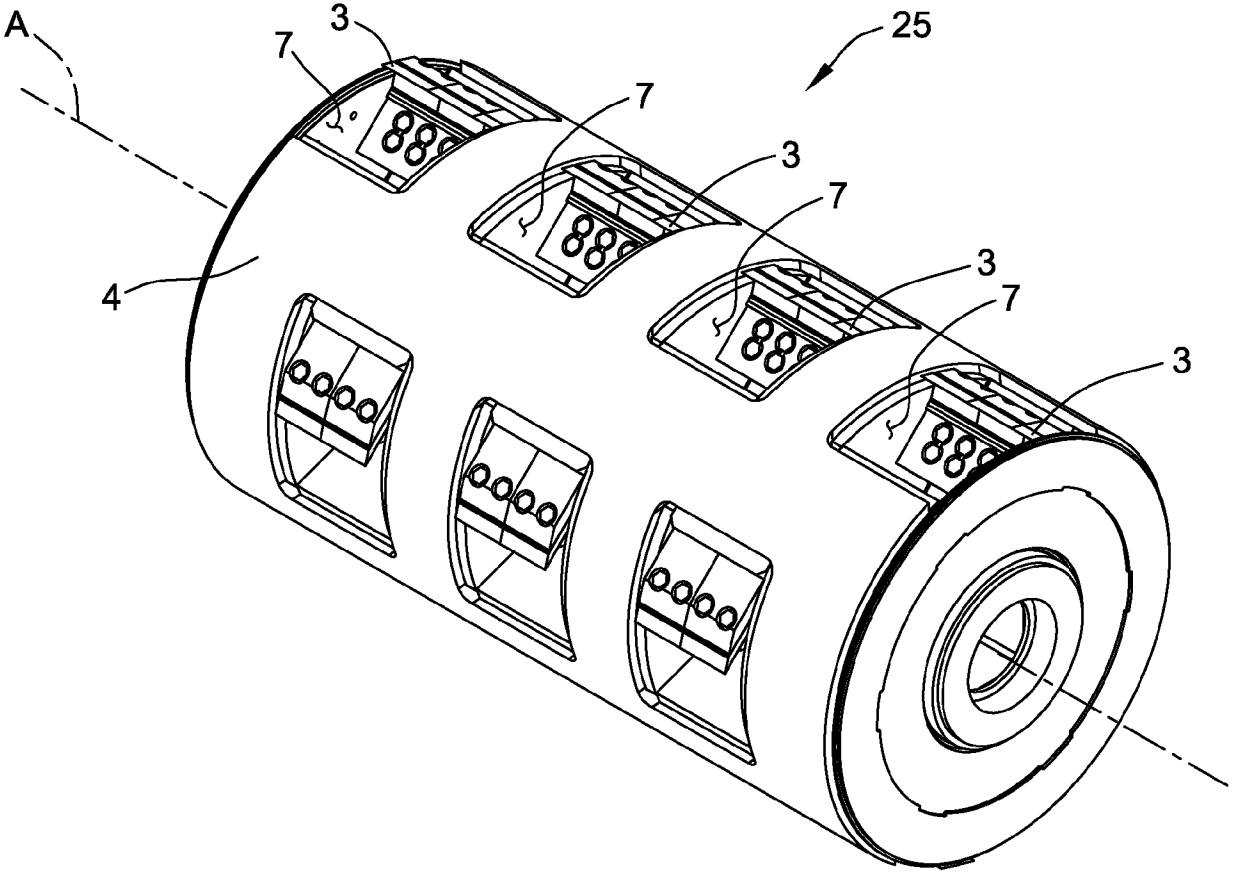
FIG. 3 is a perspective view of the comminuting drum.

As shown in FIG. 3, the comminuting drum 25 rotates about an axis A. The drum 25 includes a shell 4 and several pockets 7 formed in the shell. The pockets 7 are arranged in several rows that are parallel to the axis. However, the pockets 7 may be arranged in any suitable pattern and may be staggered over the circumference of the shell 4. Each pocket 7 includes a reducing assembly 3 that is mounted within the pocket and that partially radially extends from the pocket to define a reducing path of the comminuting drum 25.

While the comminuting apparatus may be described herein as having pockets 7 in the comminuting drum 25, it should be noted that any suitable arrangement may be used (e.g., drums without pockets). For example, the apparatus may have a pin and plate design or the reducing elements may be attached directly to the shell of the drum. Any of the principles described herein (e.g., dual mount mounting block) with reference to such pockets should be understood to extend to other designs unless stated otherwise.

Figure 4:
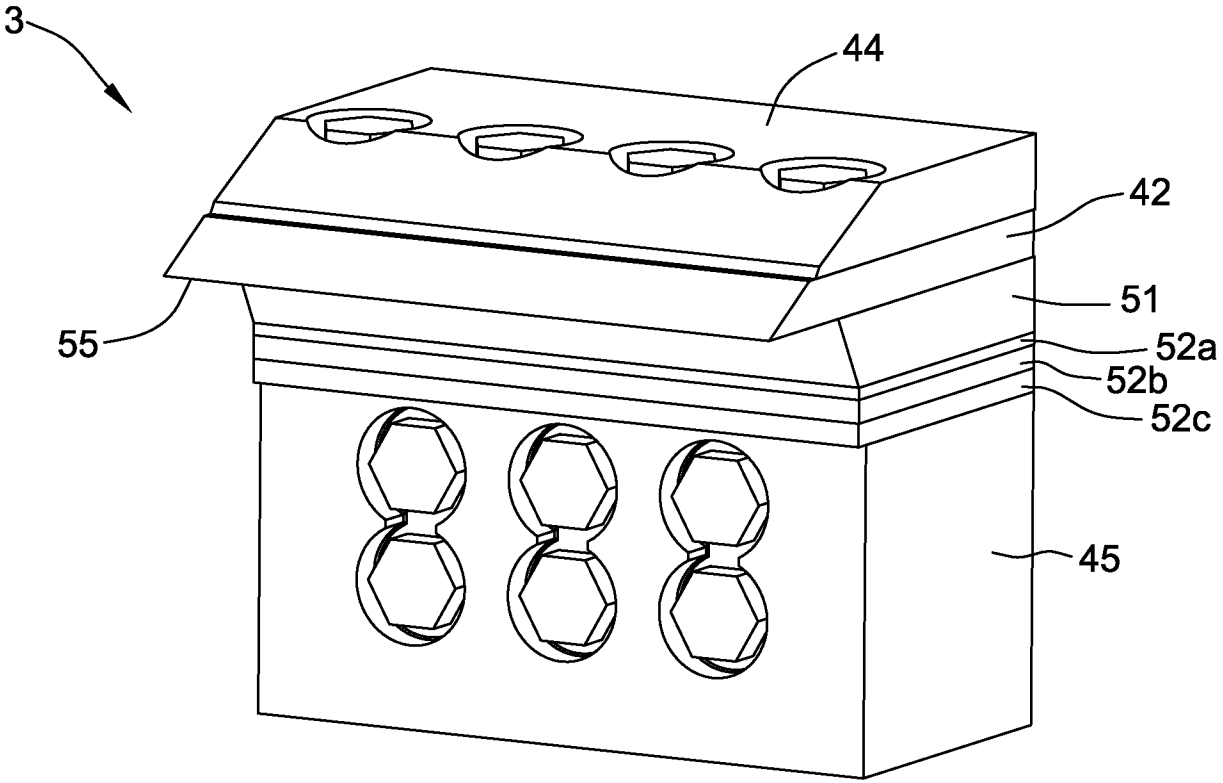
FIG. 4 is a perspective view of a reducing assembly of the comminuting drum.
Figure 5:
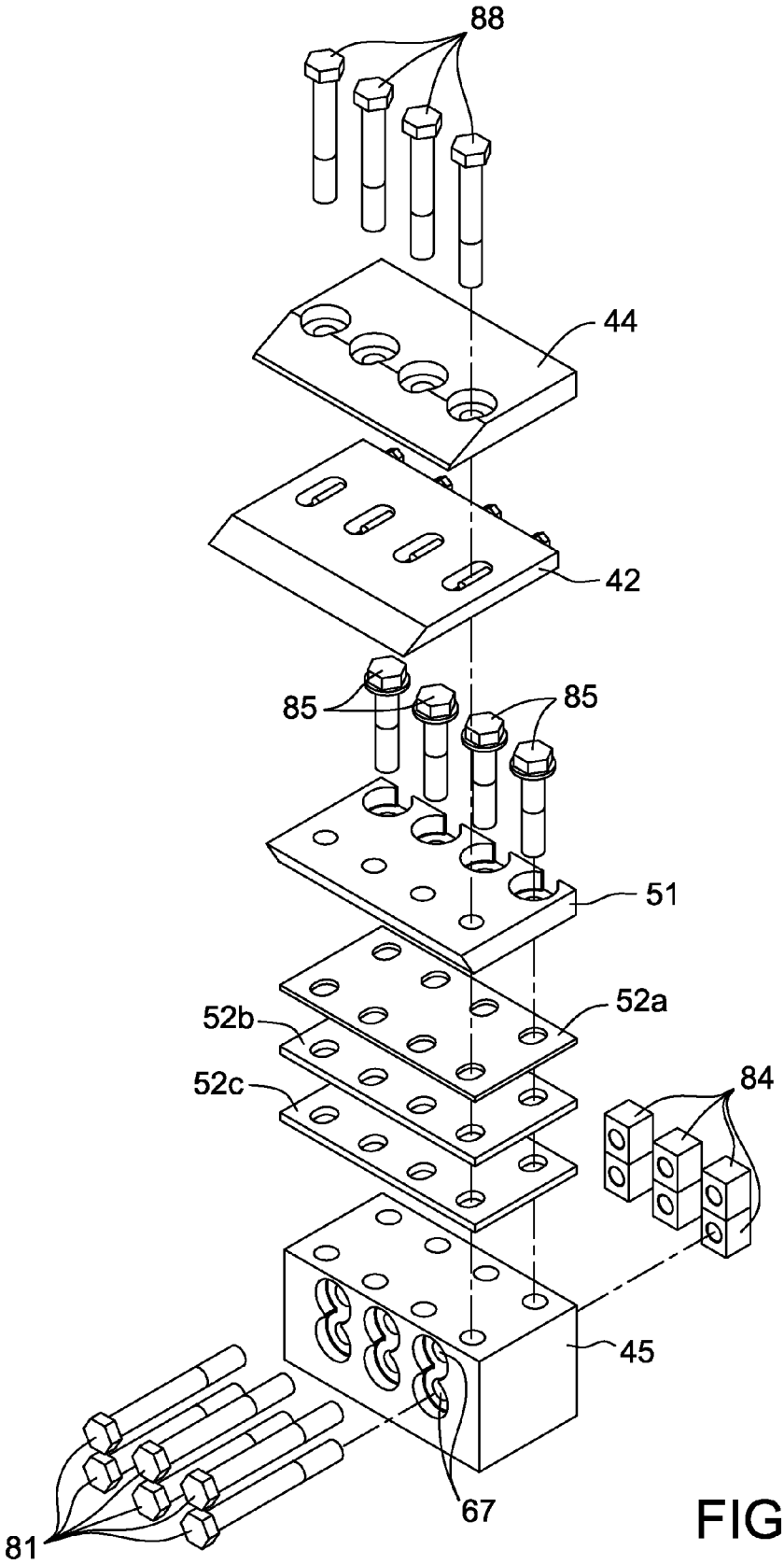
FIG. 5 is an exploded perspective view of the reducing assembly.

Each reducing assembly 3 includes a mounting block 45 for attaching a reducing element 42 (FIGS. 4 and 5). The reducing element 42 has a reducing edge 55 for comminuting material. The reducing element 42 is disposed between a support plate 51 and a clamping plate 44. The reducing assembly 3 may further include any number of spacers or "shims" 52*a*, 52*b*, 52*c*, of which 3 are illustrated. While the various components of the reducing assembly 3 are shown as being unitary pieces, such components may be several pieces which are combined to form a functional element (e.g., the clamping plate 44, reducing element 42 and/or the support plate 51 may have two distinct halves (not shown) that are combined to form the clamping plate, knife blade and/or support plate).

Figure 8:
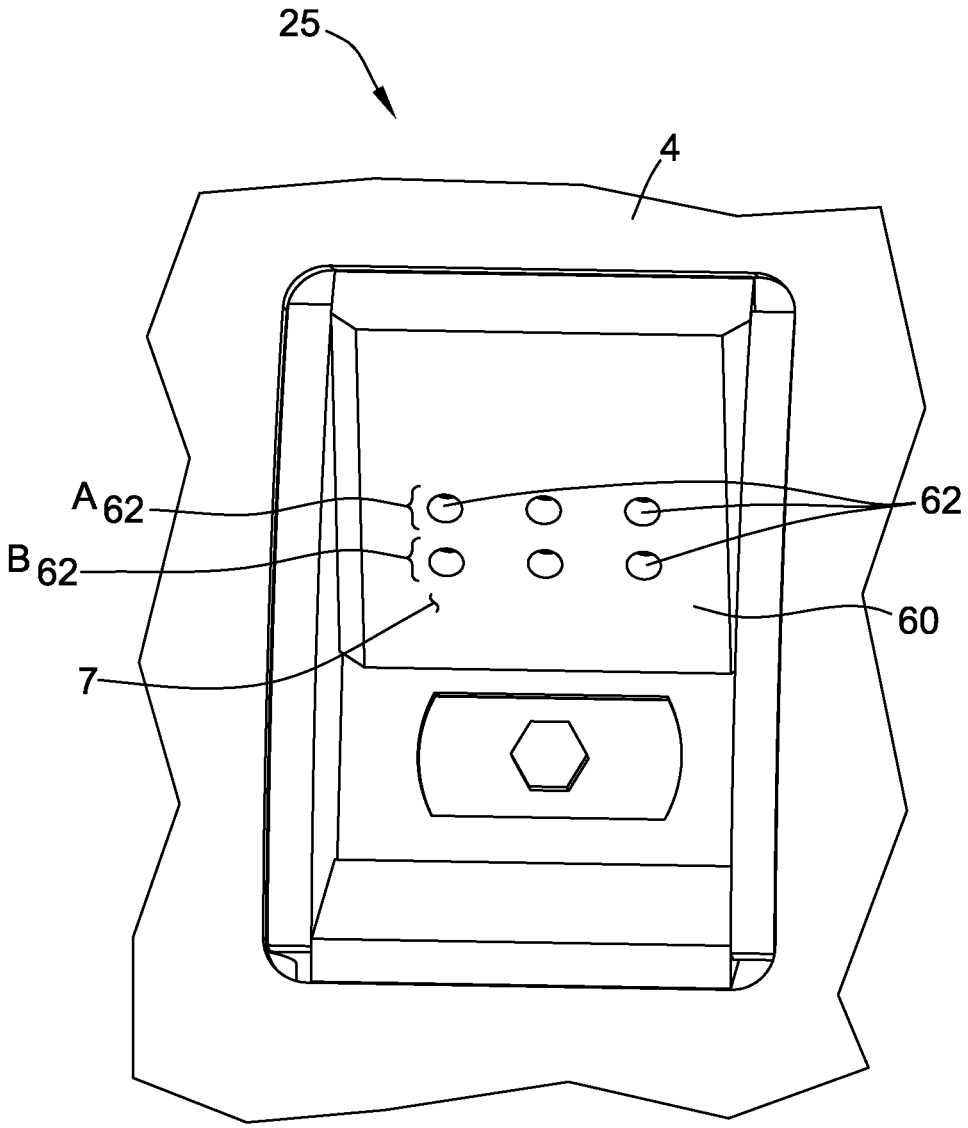
FIG. 8 is a front view of a pocket of the comminuting drum.

Referring now to FIG. 8 (reducing element not shown), each pocket 7 includes a mounting surface 60 configured for mounting the reducing assembly 3 (FIG. 4) to the comminuting drum 25. The mounting surface 60 includes surface through-holes 62 which align with block through-holes 67 (FIG. 6) formed in the mounting block 45. The mounting surface 60 includes a first (or "top") row $A_{62}$ of surface through-holes 62 and a second (or "bottom") row $B_{62}$ of surface through-holes 62. Both rows $A_{62}$, $B_{62}$ are both parallel to the axis of rotation A (FIG. 3) of the comminuting drum 25.

Figure 6:
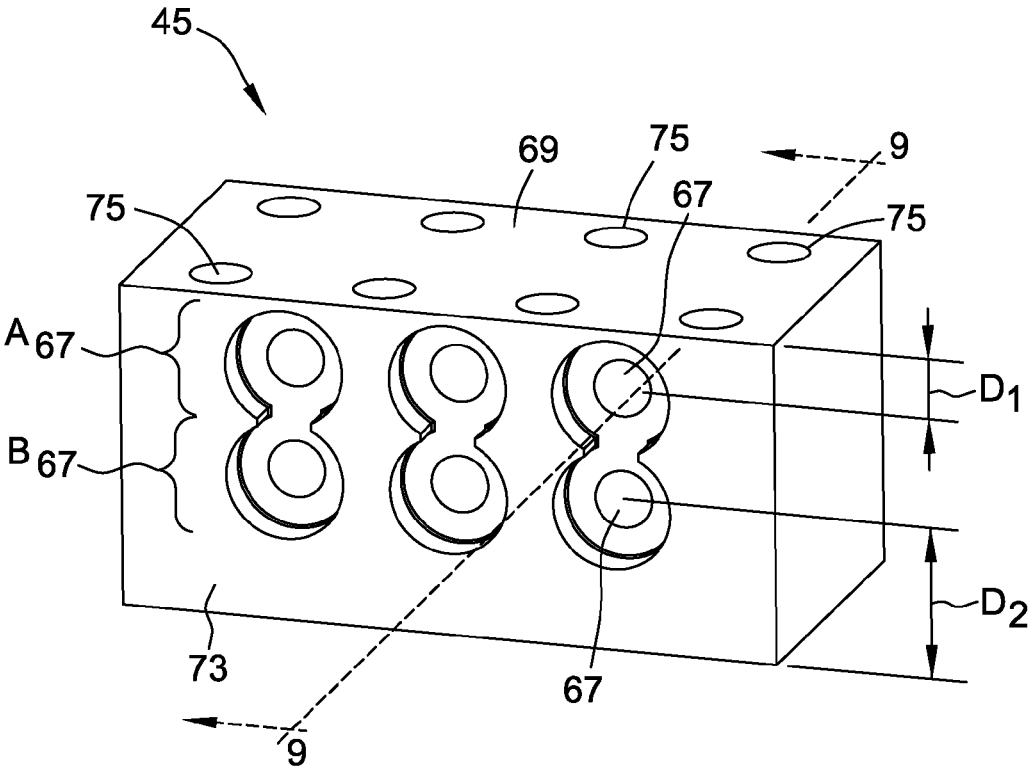
FIGS. 6-7 are perspective views of a mounting block of the reducing element.
Figure 7:
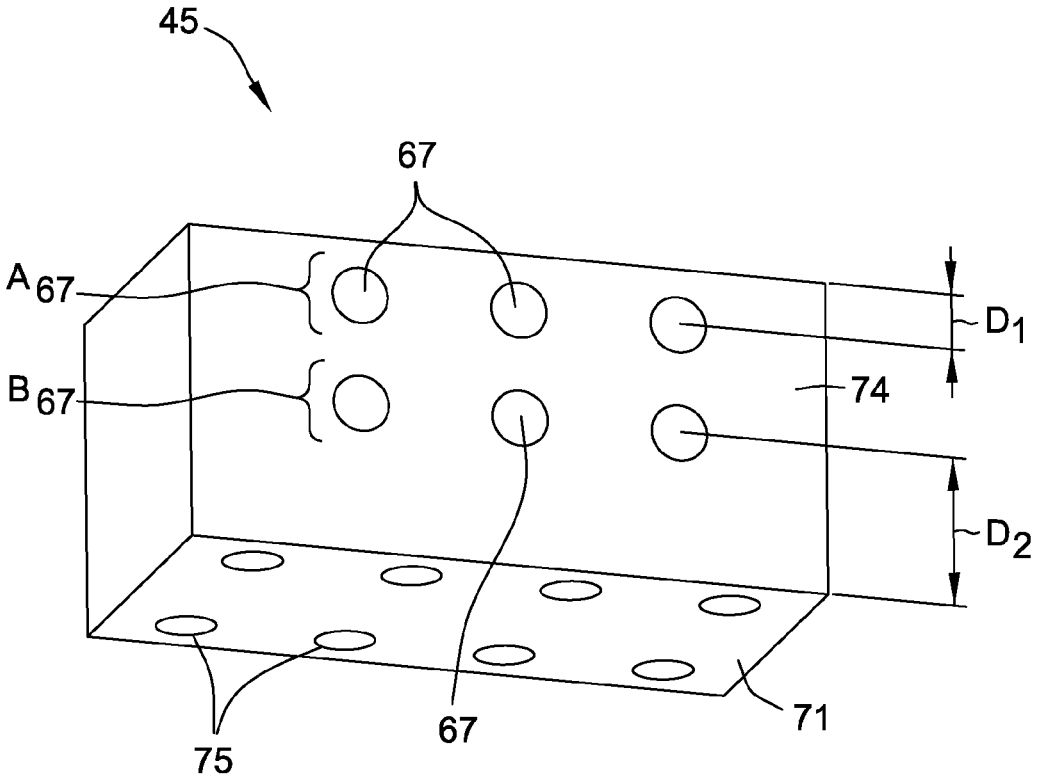

The mounting block 45 includes a top surface 69 (FIG. 6), a bottom surface 71 (FIG. 7) opposite the top surface, a front-mounting surface 73 (FIG. 6) and a back mounting surface 74 (FIG. 7). The mounting block 45 includes a first row $A_{67}$ of block through-holes 67 and a second row $B_{67}$ of block through-holes 67. Both rows $A_{67}$, $B_{67}$ are parallel to the top surface 69 and bottom surface 71 of the mounting block 45 and are also parallel to the axis of rotation A (FIG. 3) of the comminuting drum 25. It should be noted that the term "through-holes" may include through-slots unless stated otherwise.

The first and second rows $A_{62}$, $B_{62}$ of surface through-holes 62 and first and second rows $A_{67}$, $B_{67}$ of block through-holes 67 are illustrated as having 3 through-holes. However, it should be noted that each row $A_{62}$, $B_{62}$, $A_{67}$, $B_{67}$ may include more or less through-holes (e.g., 1, 2, 3, 4, 5 or 6 or more through-holes) without departing from the scope of the present disclosure.

The block through-holes 67 in the mounting block 45 are arranged such that the block may be mounted to the mounting surface 60 (FIG. 8) of the pocket 7 in two different positions. In both positions, the back surface 74 (FIG. 7) of the mounting block 45 abuts the mounting surface 60 (FIG. 8) of the pocket 7. In position 1, the first row $A_{67}$ of block through-holes 67 of the mounting block 45 (FIG. 6) are aligned with the first row $A_{62}$ (FIG. 8) of surface through-holes 62 of the mounting surface 60 and the second row $B_{67}$ of block through-holes 67 of the mounting block 45 align with the second row $B_{62}$ of surface through-holes 62 of the mounting surface 60. In position 1, the reducing element 42 (FIG. 5) is disposed on the top surface 69 (FIG. 6) of the mounting block 45.

In position 2, the mounting block 45 is inverted from position 1 causing the second row $B_{67}$ (FIG. 7) of block through-holes 67 to align with the first row $A_{62}$ (FIG. 8) of surface through-holes 62 of the mounting surface 60. The first row $A_{67}$ (FIG. 7) of block through-holes 67 align with the second row $B_{62}$ (FIG. 8) of surface through-holes 62 in the mounting surface 60. In position 2, the reducing element 42 (FIG. 5) is disposed on the bottom surface 71 (FIG. 7) of the mounting block 45.

The mounting block 45 includes openings 75 (FIG. 6) that extend through the top surface 69 for mounting the reducing element 42 (FIG. 4), clamping plate 44, support plate 51 and spacers 52*a*, 52*b*, 52*c* to the top surface 69 (FIG. 6) of the mounting block 45 when the mounting block 45 is mounted to the mounting surface 60 (FIG. 8) of the pocket 7 in position 1. The openings 75 also extend through the bottom surface 71 (FIG. 7) of the mounting block 45 for mounting the reducing element 42 (FIG. 4), clamping plate 44, support plate 51 and spacers 52*a*, 52*b*, 52*c* to the bottom surface 71 (FIG. 7) of the mounting block 45 when the mounting block 45 is mounted to the mounting surface 60 of the pocket in position 2. The mounting block 45 may include any suitable number of openings 75 for mounting the reducing element 42 (FIG. 4), clamping plate 44, support plate 51 and spacers 52*a*, 52*b*, 52*c* to the mounting block 45 such as, for example, at least about 2 through-holes or at least about 4, at least about 6, at least about 8 or even more openings 75.

Figure 9:
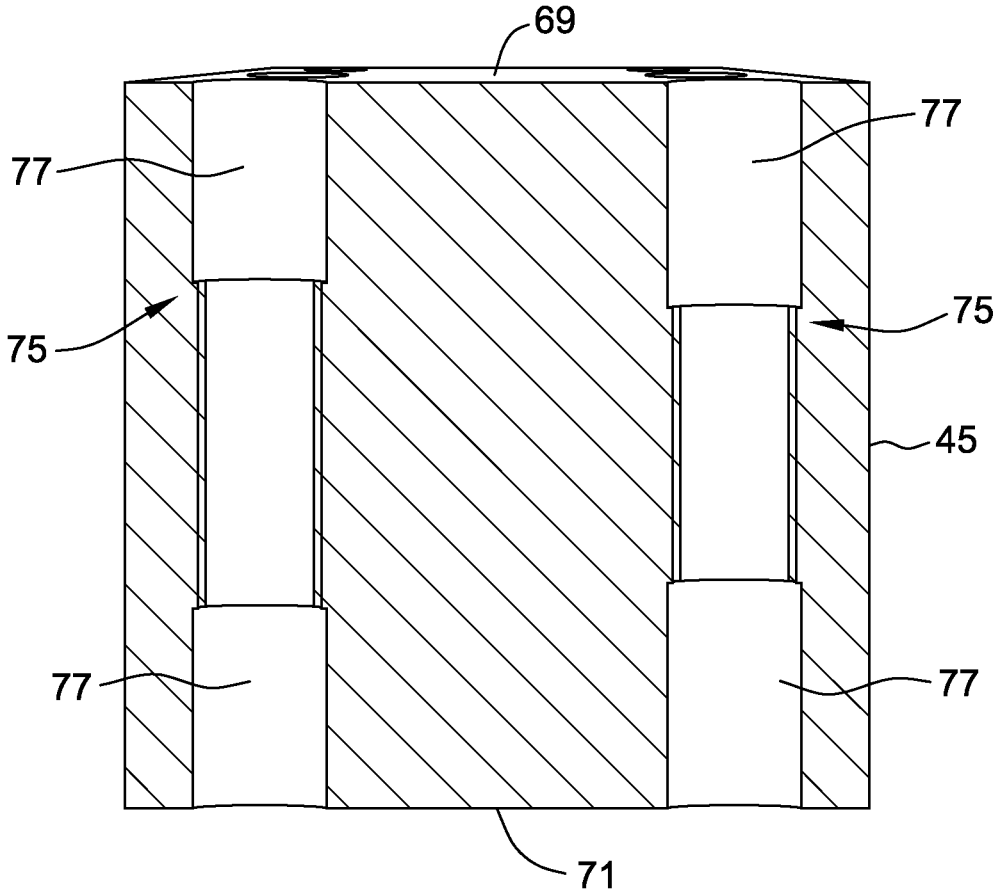
FIG. 9 is a perspective view of another embodiment of the mounting block.

Referring now to FIG. 9, each opening 75 may include two counter-bores 77 which allow a fastener (not shown) to be inset within the block. Use of counter-bores 77 at the top surface 69 and bottom surface 71 allows the block to be inverted in two different mounting positions as further described below.

Row $A_{67}$ (FIGS. 6 and 7) of block through-holes 67 that extend through the mounting block 45 are nearer to the top surface 69 (FIG. 6) and row $B_{67}$ of block through-holes 67 are nearer the bottom surface 71 (FIG. 7) of the mounting block 45. Row $A_{67}$ (FIG. 6) of block through-holes 67 is at a distance $D_1$ from the top surface 69 and row $B_{67}$ of block through-holes 67 is at a distance $D_2$ from the bottom surface 71 (FIG. 7). $D_1$ is generally different from $D_2$ (e.g., $D_1$ is least about 5% greater or less than $D_2$ or is at least about 10% greater or less than $D_2$). By using different distances $D_1$ and $D_2$, the "bite" (i.e., the distance between the tip of the reducing element and the shell of the drum as shown in FIGS. 11 and 12) of the comminuting drum 25 (FIG. 2) may be varied by changing between mounting position 1 and position 2.

When $D_1$ is less than $D_2$, use of mounting position 1 results in a smaller bite (and also a reducing path of a reduced diameter) relative to the bite of the comminuting drum when the mounting block is in position 2. When $D_1$ is greater than $D_2$, use of mounting position 1 results in a greater bite (and a reducing path of a greater diameter) relative to the bite of the comminuting drum when the mounting block is in position 2.

When the bite of the reducing elements 3 of the comminuting drum (FIG. 2) are varied, the anvil may be adjusted by any suitable method to maintain a targeted clearance with the reducing elements. It should be noted that while use of mounting positions 1 and 2 may be used to vary the bite of the reducing elements, the multiple positions may, alternatively, be used to vary the clearance with the anvil.

Figure 11:
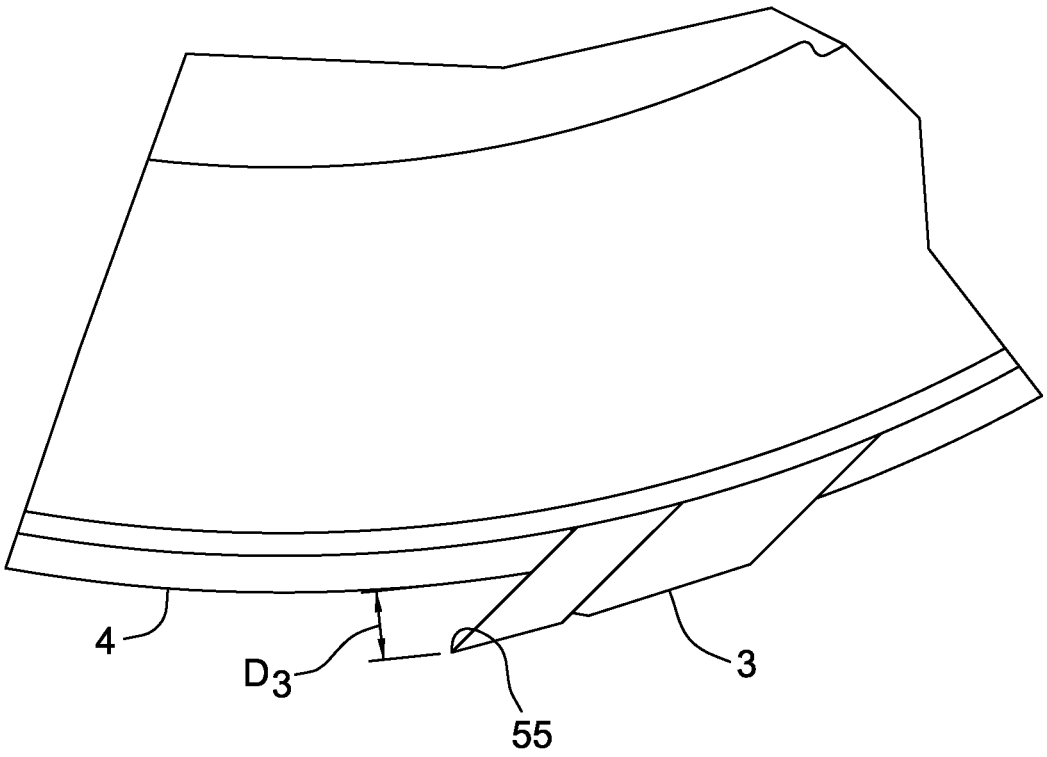
FIG. 11 is a side view of the comminuting drum with a reducing element bite size of $D_3$.
Figure 12:
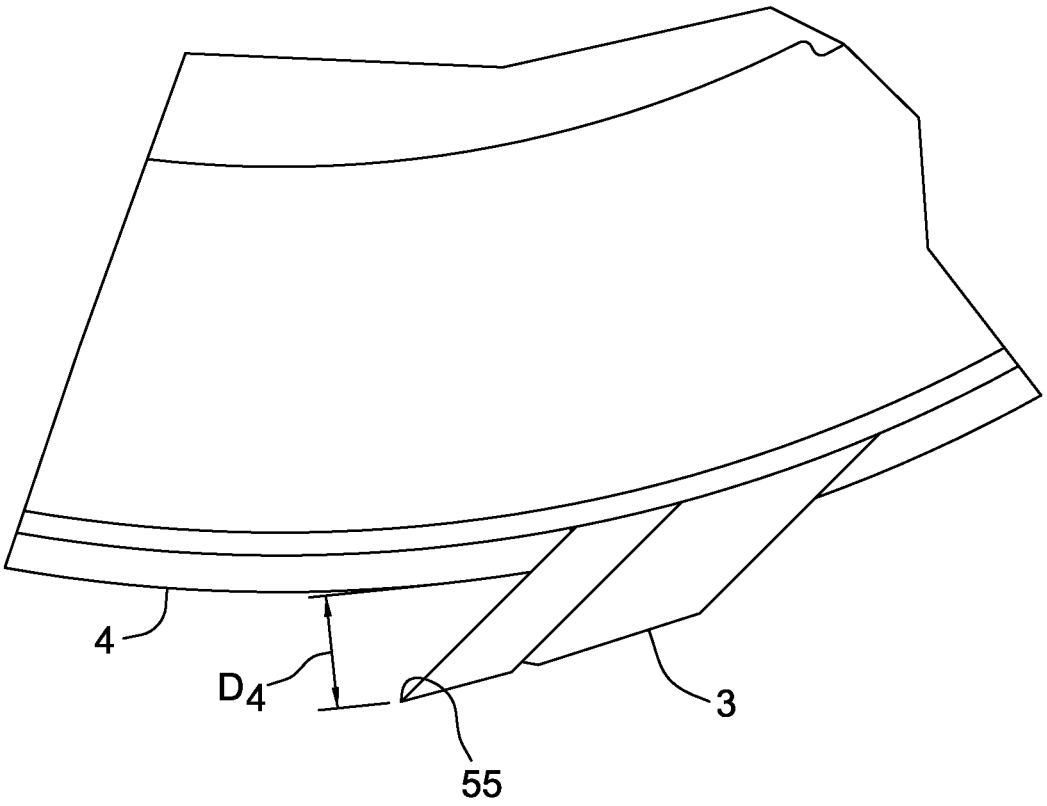
FIG. 12 is a side view of the comminuting drum with a reducing element bite size of $D_4$.

As shown in FIG. 11, use of mounting position 1 results in a distance $D_3$ between the reducing edge 55 of the reducing element of the reducing assembly 3 and the shell 4 of the comminuting drum 25. Position 2 results in a distance $D_4$ (FIG. 12) between the reducing edge 55 of the knife blade of the reducing assembly 3 and the shell 4 of the comminuting drum 25. Distance $D_3$ is generally different from $D_4$ and, as shown in FIGS. 11 and 12, $D_3$ is less than $D_4$ resulting in less of a "bite" of the comminuting drum 25. In other embodiments, $D_3$ is greater than $D_4$.

The mounting block 45 may be secured to the mounting surface 60 (FIG. 8) of the pocket 7 by any suitable method including, for example, by use of threaded fasteners 81 (FIG. 5). The fasteners 81 are aligned with threaded bars 84. The fasteners 81 may, alternatively, be secured to the mounting surface 60 (FIG. 8) by any suitable method including, for example, use of lock nuts and/or lock washers or threading of any of the various through-holes. Threaded fasteners 85 (FIG. 5) may be used to secure the support plate 51 and spacers 52*a*, 52*b*, 52*c* to the mounting block 45 and threaded fasteners 88 may be used to secure the clamping plate 44, reducing element 42, support plate 51 and spacers 52*a*, 52*b*, 52*c* to the mounting block 45.

Figure 10:
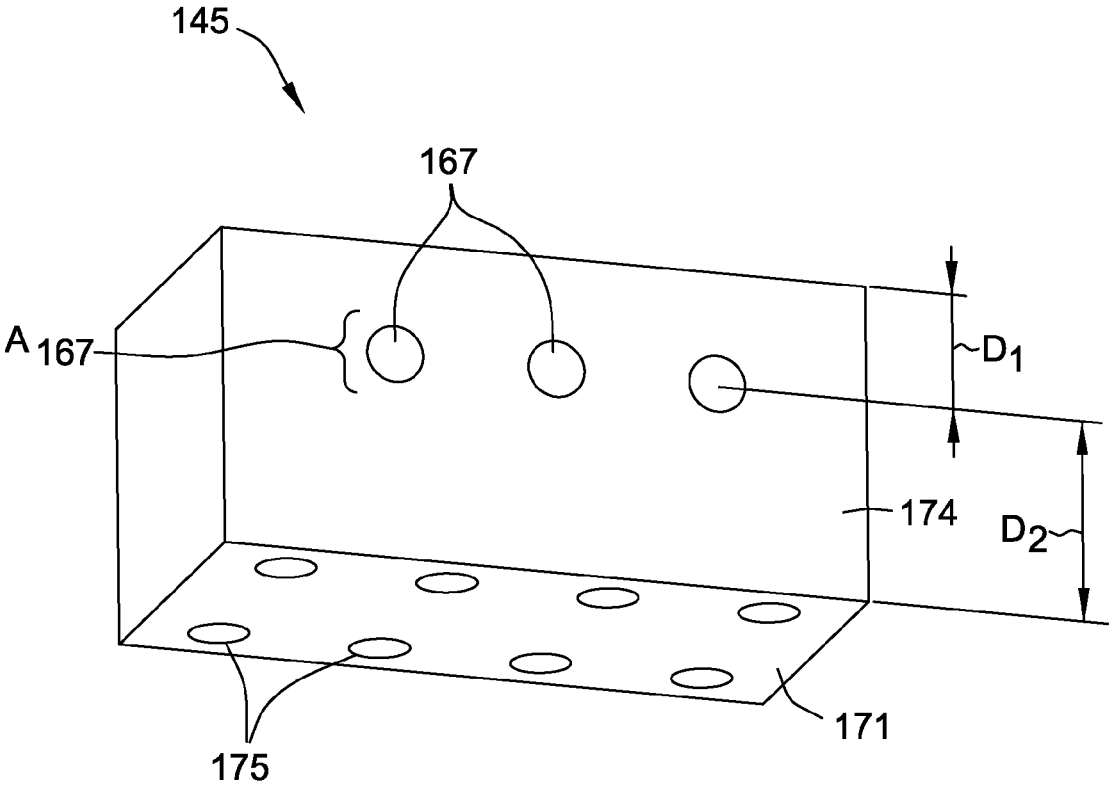
FIG. 10 is a cross-section view of the mounting block showing the openings for attaching a reducing element to the block.

Another embodiment of the mounting block 145 is shown in FIG. 10. The mounting block components and features shown in FIG. 8 that are analogous to FIGS. 6 and 7 are designated by the corresponding reference number of FIGS. 6 and 7 plus "100" (e.g., part 45 becomes part 145). As shown in FIG. 10, the mounting block 145 includes one row $A_{167}$ of block through-holes 167 that extend through the front mounting surface (not shown) and back-mounting surface 174. As described above with reference to mounting block 45, the mounting block 145 may be mounted to the mounting surface 60 (FIG. 8) in a first position in which the reducing element 42 (FIG. 4), clamping plate 44, support plate 51 and spacers 52*a*, 52*b*, 52*c* are mounted to the top surface (not shown) of the mounting block 145. Alternatively, the mounting block 145 may be inverted relative to position 1 such that the reducing element 42 (FIG. 4), clamping plate 44, support plate 51 and spacers 52*a*, 52*b*, 52*c* are mounted to the bottom surface 171 (FIG. 10) of the mounting block 145 in position 2.

The row $A_{167}$ of block through-holes 167 is at a distance $D_1$ from the front surface (not shown) of the mounting block 145 and a distance $D_2$ from the bottom surface 171. $D_1$ is different from $D_2$ such that the bite of the reducing assembly 3 (FIG. 4) may be varied.

Similar to mounting block 45 (FIGS. 6 and 7) described above, when $D_1$ is less than $D_2$ in mounting block 145, use of mounting position 1 results in a reduced bite of the reducing assembly (and a reducing path of a reduced diameter) relative to the bite when the mounting block 145 is in position 2. When $D_1$ is greater than $D_2$, use of mounting position 1 results in greater bite (and a reducing path of a greater diameter) relative to the bite when the mounting block is in position 2.

The mounting surface 60 (FIG. 8) of the pocket 7 comprises two rows of surface through-holes 62. However, the surface 60 may, alternatively, include more or less rows of surface through-holes 62. By including two or more rows, the mounting block 45 may be mounted to a sub-set of surface through-holes 62 (e.g., a relatively lower or higher set of surface through-holes 62) to vary the bite of the comminuting drum 25 (FIG. 3). Alternatively or in addition, the number and/or thickness of spacers 52*a*, 52*b*, 52*c* may be varied to adjust the bite of the comminuting drum.

In some embodiments (not shown), the mounting block 45 (FIG. 6) includes more than two-rows of block through-holes 67. By including at least two rows, the mounting block 45 may be mounted by use of a sub-set of mounting block through-holes 67 (e.g., a relatively lower or higher set of block through-holes 67) to vary the bite of the comminuting drum 25 (FIG. 3).

In accordance with embodiments of the present disclosure, the bite of the comminuting drum 25 (FIG. 3) may be varied by removing the reducing assembly 3 from the pocket 7. The clamping plate 44 (FIG. 4), reducing element 42, support plate 51 and spacers 52*a*, 52*b*, 52*c* are removed from the mounting block 45 (either before or after the mounting block is disengaged from the mounting surface 60 (FIG. 8) of the pocket 7). The clamping plate 44, reducing element 42, support plate 51 and spacers 52*a*, 52*b*, 52*c* are then remounted to the mounting block 45 on the surface (top surface 69 (FIG. 6) or bottom surface 71 (FIG. 7)) opposite the surface to which they components were previously mounted. The mounting block 45, inverted from its initial position, is then remounted to the mounting surface 60 (FIG. 8) of the pocket 7.

Compared to conventional apparatus for comminuting material, the reducing assembly 3 described above has several advantages. For example, the reducing assembly 3 allows the bite of the comminuting drum 25 (FIG. 3) to be varied over a large range of bite sizes (e.g., from 0.32 cm (⅛") to 3.81 cm (1.5")) to vary the performance of the apparatus. Such an ability to provide a larger range of bite sizes increases the flexibility of the apparatus, allowing one machine to be used to yield a bite size range that may have required two or more machines to accomplish. Further, the increased range of bite size may be accomplished with a single size of fastener (e.g., bolt) reducing the complexity in adjusting bite size. The invertible mounting block, optionally in combination with spacers, may be used to vary the bite size of the apparatus over a series of increments.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described, unless otherwise expressly stated to the contrary.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A mounting block for attaching a reducing element to a rotary drum for comminuting material, the mounting block comprising:

a top surface;

a bottom surface opposite the top surface;

a front mounting surface;

a back mounting surface opposite the front mounting surface;

at least two rows of block through-holes within the mounting block that are parallel to the top surface and bottom surface, the block through-holes being configured for attaching the mounting block to the rotary drum, the block through-holes extending through the front mounting surface and the back mounting surface, the top row of block through-holes nearest the top surface being a distance $D_1$ from the top surface, the bottom row of block through-holes nearest the bottom surface being a distance $D_2$ from the bottom surface, wherein $D_1$ is generally different from $D_2$; and an opening that extends through the top surface, the opening being configured for attaching a reducing element to the mounting block.

2. The mounting block as set forth in claim 1 wherein the opening extends through the bottom surface.

3. A mounting block for attaching a reducing element to a rotary drum for comminuting material, the mounting block comprising:

a top surface;

a bottom surface opposite the top surface;

a front mounting surface;

a back mounting surface opposite the front mounting surface;

a row of block through-holes that are parallel to the top surface and bottom surface, the block through-holes being configured for attaching the mounting block to the rotary drum, the block through-holes extending through the front mounting surface and back mounting surface, the row of block through-holes being a distance $D_1$ from the top surface and a distance $D_2$ from the bottom surface, wherein $D_1$ is generally different from $D_2$; and an opening that extends through the top surface, the opening being configured for attached a reducing element to the mounting block.

4. The mounting block as set forth in claim 3 in combination with a reducing element mounted to the mounting block, the reducing element having a reducing edge for comminuting material.

5. The mounting block as set forth in claim 3 wherein the opening extends through the bottom surface for mounting a reducing element to the mounting block.

6. The mounting block as set forth in claim 3 comprising no more than one row of block through-holes.

7. A rotary drum for comminuting material, the rotary drum having an axis of rotation and comprising:

a drum mounting surface;

a mounting block removably mounted to the mounting surface, the mounting block comprising:

a front mounting surface;

a back mounting surface opposite the front mounting surface, the back mounting surface abutting the drum mounting surface;

at least two rows of block through-holes that extend through the front mounting surface and back mounting surface, the rows being parallel to the axis of the drum;

a top surface;

a bottom surface opposite the top surface;

an opening that extends through the top surface and bottom surface configured for attaching the reducing element to the mounting block; and a reducing element mounted to the mounting block, the reducing element having a reducing edge for comminuting material.

8. The rotary drum as set forth in claim 7 wherein the top row of block through-holes nearest the top surface are a distance $D_1$ from the top surface, the bottom row of block through-holes nearest the bottom surface are a distance $D_2$ from the bottom surface, $D_1$ being generally different from $D_2$.

9. The rotary drum as set forth in claim 8 comprising:

a row of surface through-holes that extend through the drum mounting surface, the row of surface through-holes being parallel to the axis of the drum and aligning with the block through-holes; and threaded fasteners which extend through the mounting block into the surface through-holes.

10. The rotary drum as set forth in claim 7 wherein the mounting block comprises two rows of block through-holes and the drum mounting surface comprises two rows of surface through-holes that extend through the mounting surface, each row of surface through-holes being parallel to the axis of the drum and aligning with a row of block through-holes.

11. The rotary drum as set forth in claim 7 wherein the drum mounting surface comprises two or more rows of surface through-holes that extend through the mounting surface, each row of surface through-holes being parallel to the axis of the drum and aligning with a row of block through-holes.

12. The rotary drum as set forth in claim 7 wherein the reducing element is removably mounted to the mounting block.

13. The rotary drum as set forth in claim 7 comprising a spacer disposed between the mounting block and the reducing element.

14. The rotary drum as set forth in claim 7 wherein the reducing element is selected from the group consisting of a tooth, grinding element and knife.

15. The rotary drum as set forth in claim 7 wherein the reducing element is a knife.

16. A method for adjusting the bite of the reducing element of the comminuting drum of claim 7, the rows of block through-holes being parallel to the top surface and bottom surface, the reducing element being disposed on the top surface of the mounting block, the method comprising:

removing the mounting block from the mounting surface;

removing the reducing element from the top surface of the mounting block;

mounting the reducing element to the mounting block such that the reducing element is disposed on the bottom surface of the mounting block; and mounting the mounting block to the mounting surface after the reducing element has been mounted to the mounting block such that the reducing element is disposed on the bottom surface of the mounting block.

17. The method as set forth in claim 16 wherein the drum has a shell, a distance $D_3$ being defined between a reducing edge of the reducing element and the shell when the mounting block is mounted to the mounting surface with the reducing element being disposed on the top surface of the mounting block and a distance $D_4$ is defined between a reducing edge of the reducing element and the shell when the mounting block is mounted to the mounting surface with the reducing element being disposed on the bottom surface of the mounting block, $D_3$ being generally different than $D_4$.

18. The method as set forth in claim 17 wherein $D_3$ is less than $D_4$.

19. The method as set forth in claim 17 wherein $D_3$ is greater than $D_4$.

20. The method as set forth in claim 16 wherein the top row of block through-holes nearest the top surface of the mounting block are a distance $D_1$ from the top surface and the bottom row of block through-holes nearest the bottom surface of the mounting block are a distance $D_2$ from the bottom surface, $D_1$ being generally different from $D_2$.

* * * * *